US005215361A

United States Patent [19]

Brock, Jr. et al.

[11] Patent Number: 5,215,361

[45] Date of Patent: Jun. 1, 1993

[54] PREFABRICATED FRAME FOR WOOD PANEL ASSEMBLY

[75] Inventors: Thomas E. Brock, Jr., Hendersonville, N.C.; Karen S. Besselsen, Grandville, Mich.; Kenneth J. Burke, Hendersonville, N.C.; Orrin W. DeJonge, Hendersonville, N.C.; John E. Halberg, Hendersonville, N.C.; John J. Hasbany, Kentwood, Mich.; Brian J. Kane, San Francisco, Calif.; Alfred F. Mittl, Fairview, N.C.; Robert D. Smith, Fletcher, N.C.; Glenn F. Stroupe, Arden, N.C.; Jerry L. Whiteford, Arden, N.C.

[73] Assignee: Steelcase Inc., Grand Rapids, Mich.

[21] Appl. No.: 711,647

[22] Filed: Jun. 6, 1991

[51] Int. Cl.[5] ..... A47B 13/02

[52] U.S. Cl. ..... 312/195; 312/263; 312/257.1; 403/231

[58] Field of Search ..... 312/195, 257.1, 265.1-265.4, 312/263; 403/231, 262, 407.1

[56] References Cited

U.S. PATENT DOCUMENTS

| | | |
|---|---|---|
| D. 90,691 | 9/1933 | Wilson . |
| D. 163,353 | 5/1951 | Belanger . |
| D. 171,630 | 3/1954 | Zimmermann . |
| D. 258,184 | 2/1981 | Nelson . |
| D. 286,832 | 11/1986 | Matthews et al. . |
| D. 292,151 | 10/1987 | Becker . |
| 861,911 | 7/1907 | Stewart . |
| 2,118,525 | 5/1938 | Richardson . |
| 2,126,916 | 8/1938 | Parrish . |
| 2,218,961 | 10/1940 | Schulz . |
| 2,284,480 | 5/1942 | Schuh . |
| 2,328,019 | 8/1943 | Jones . |
| 2,595,473 | 5/1952 | O'Connor . |
| 2,858,179 | 10/1958 | Puerner et al. . |
| 3,229,029 | 1/1966 | Weiss . |
| 3,284,152 | 11/1966 | Schorghuber . |
| 3,313,587 | 4/1967 | Mongesku et al. . |
| 3,418,030 | 12/1968 | Golden . |
| 3,429,631 | 2/1969 | Neyroud . |
| 3,479,102 | 11/1969 | Wallach et al. . |
| 3,490,602 | 1/1970 | Wentzel . |
| 3,612,639 | 10/1971 | Williams . |
| 3,613,931 | 10/1971 | Schifferie . |
| 3,752,553 | 8/1973 | Bildahl et al. . |
| 3,779,177 | 12/1973 | Gigante . |
| 3,838,902 | 10/1974 | Tenani . |
| 3,897,876 | 8/1975 | Feldman . |
| 3,950,813 | 4/1976 | Buck . |
| 3,989,397 | 11/1976 | Baker . |
| 4,015,886 | 4/1977 | Wickenberg . |
| 4,036,542 | 7/1977 | Courtwright . |
| 4,053,192 | 10/1977 | Spetner . |
| 4,067,161 | 1/1978 | Rensch . |
| 4,106,630 | 8/1978 | Rosenband . |
| 4,132,489 | 1/1979 | Berg, Jr. et al. . |
| 4,186,976 | 2/1980 | Okada . |
| 4,191,439 | 3/1980 | Cohen . |
| 4,217,012 | 8/1980 | Klaus . |

(List continued on next page.)

FOREIGN PATENT DOCUMENTS

| | | |
|---|---|---|
| 968765 | 6/1975 | Canada . |
| 2531649 | 1/1976 | Fed. Rep. of Germany . |
| 471564 | 4/1969 | Switzerland . |

*Primary Examiner*—Peter R. Brown
*Attorney, Agent, or Firm*—Price, Heneveld, Cooper, DeWitt & Litton

[57] ABSTRACT

An article of furniture is provided which is readily assembleable with a minimum of parts and tools, and yet provides a neat, finished appearance. The furniture article includes at least one rigid elongate connector bracket interposed between at least one side panel and a top panel, the connector bracket including separate portions which fixedly secure the side panel to the top panel. The top panel and side panel form a groove-like seam therebetween which the connector bracket covers to provide a neat finished appearance. In one embodiment, the furniture article includes snap-lock.

41 Claims, 7 Drawing Sheets

U.S. PATENT DOCUMENTS 4,239,306 12/1980 Klaus .
4,270,820 6/1981 McMullan et al. .
4,290,371 9/1981 Snitzer et al. .
4,449,643 5/1984 Voegeli .
4,456,299 6/1984 Steinmetz .
4,473,166 9/1984 Breiter .
4,477,201 10/1984 Yoshiyuji .
4,497,093 2/1985 Haberkorn ..... 312/195 X
4,589,794 5/1986 Sugiura et al. .
4,620,636 11/1986 Herr et al. .
4,643,493 2/1987 Sides, Sr. et al. .
4,650,143 3/1987 Kurrasch .
4,650,261 3/1987 Winter et al. .
4,719,337 1/1988 Hudson et al. .
4,728,158 3/1988 D'Elia et al. .
4,815,796 3/1989 Rock et al. .
4,874,212 10/1989 Rock et al. .
4,883,303 11/1989 Gross .
4,884,854 12/1989 Joffe .
4,918,899 4/1990 Karytinos .
4,948,204 8/1990 Kilmartin, III .

PREFABRICATED FRAME FOR WOOD PANEL ASSEMBLY

BACKGROUND OF THE INVENTION

The present invention relates to furniture, and in particular to a prefabricated frame construction for wood furniture and the like.

Wood furniture is used extensively in offices, homes and the like to provide a natural and aesthetic appearance. Such furniture has a rich appearance and is traditionally regarded as prestigious or up-level. However, wood furniture requires special care to avoid damage to the various wooden parts, especially around exposed joints which are particularly prone to chipping and scratching, both during manufacture of individual parts, and also during assembly. Not only are purchasers particularly sensitive to wood damage, but wooden parts are not easily repaired in an acceptable manner due to the natural grain of the wood.

Compounding these quality problems are problems encountered during assembly. Wood furniture often utilizes multiple non-uniform parts, thus leading to logistical problems of inventory control and material flow to the point of assembly. Often, the wood panels require multiple machining or specialized tooling and assembly techniques. Efforts to reduce the amount of parts, and to otherwise simplify assembly has lead to the use of glues and adhesives. However, these are often messy and difficult to reliably control. Further, they require clamps and cure times that are inconsistent with an efficient assembly process. Thus, assembly of wood furniture tends to continue to include a considerable amount of custom-build labor.

Also desirable is an assembly arrangement which combines the advantages of plastic or other structural formable materials without detracting from the aesthetic and prestigious appearance of the wood furniture.

Thus, improvements are desired in the assembly of wood furniture to simplify and improve assembly by reducing the need for specialized tools, parts, and assembly skills, reducing the amount of machining, finishing and parts required, reducing the quality problems such as scratching and chipping, and generally improving manufacturing efficiency.

SUMMARY OF THE INVENTION

The present invention fulfills the aforementioned needs by providing an article of furniture which is readily assembleable with a minimum of parts and tools, and yet provides a neat finished appearance.

In one form, the invention is an improved pedestal construction that includes two structural panels, and upper and lower connector brackets each having channels shaped to closely receive upper and lower edges of the two structural panels. The connector brackets include a trim apron that extends substantially continuously along the channels and that overlies at least the exterior surfaces of the two panels to impart a neat, finished appearance thereto. The connector brackets further include structure to fasten the two structural panels to a top.

In another one form, the invention provides first and second connector brackets having a channel for receiving and capturing opposing edges on each of first and second panels to fix the spacial position the opposing edges. Connector brackets include an attaching mechanism for initially, temporarily interconnect the two panels to form a semi-rigid assembly with a third panel to facilitate assembly, and also including an attaching mechanism for permanently, rigidly interconnecting the same.

In yet another form, a connector bracket includes a channel having a generally continuous shaped structure for receiving and capturing first and second panels, and also including a snap-lock for temporarily holding the first and second panels to a third panel and a fastener receiving for permanently interconnecting the same.

In still another form, the connector bracket includes portions interconnecting first and second panels, and further including a trim apron extending generally continuously along the butt joint formed between the two panels. The trim apron has a free edge which mates with an interior face of one of the panels and further includes a decorative outer surface.

In still another form, four connector brackets join with four panels to form a desk-like configuration, the connector brackets including channel means to temporarily fix the spacial position of the four panels and also attaching means to interconnectingly form a permanent rigid assembly therebetween.

In still another form, the invention provides a method of assembling furniture including providing first, second, and third panels, and providing first and second elongate connector brackets. The method further includes the steps of inserting opposing edges of two of the panels into captured positions in the two connector brackets to form a semi-rigid intermediate assembly, and then securely interconnecting the three panels to form a rigid assembly.

As will be understood, numerous advantages over the prior known art is provided by this invention. The invention reduces assembly time and reduces the need for specialized tools such as clamps, and the like. Further, parts require less machining and processing, and are more adaptable to future designs. Additionally, problems due to stack-up of tolerances are reduced, with tolerances in some cases being able to be loosened. Also, the reduced number of parts and modular design allows considerable savings in assembly time and cost from a reduced need to "custom build" each furniture article. Further, the skill level required for assembly is reduced. Still further, quality is improved and manufacturing cost reduced since the present invention is comprised of a minimum number of parts which are therefore easier to control. Quality is further improved since the techniques for assembly such as the snap-lock assembly tend to minimize scratches and damage. Further, some of the wood panel edges are hidden by the connector brackets. Additionally, the notches and grooves required are not complex, therefore reducing part preparation time and simplifying the part manufacturing process.

One aspect of the present invention is to mateably receive and cover an edge of the side panel thereby reducing the need for a finished undamaged surfaces along the top and bottom edges of the side panel. Thus, even side panels having significant scratches, nicks or damage to the top and bottom edge surface are potentially useable without complaint.

Another aspect is to aesthetically cover the butt joint formed with a trim apron between the side panel and the top panel, thereby complementing the aesthetic quality of the wood.

These and other advantages, purposes and features of the invention will become more apparent from a study of the following description taken in connection with the drawings.

DETAILED DESCRIPTION OF THE PREFERRED EMBODIMENTS

Figure 1:
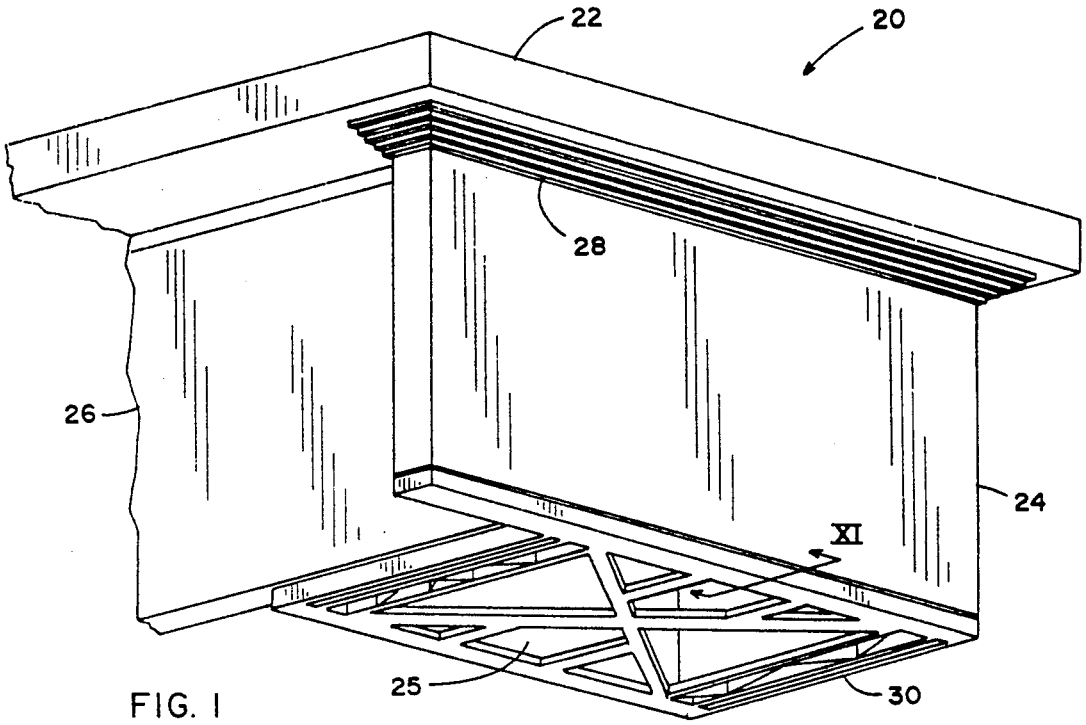
FIG. 1 is a fragmentary perspective view of a furniture article incorporating the present invention, taken from a front and bottom portion thereof.
Figure 2:
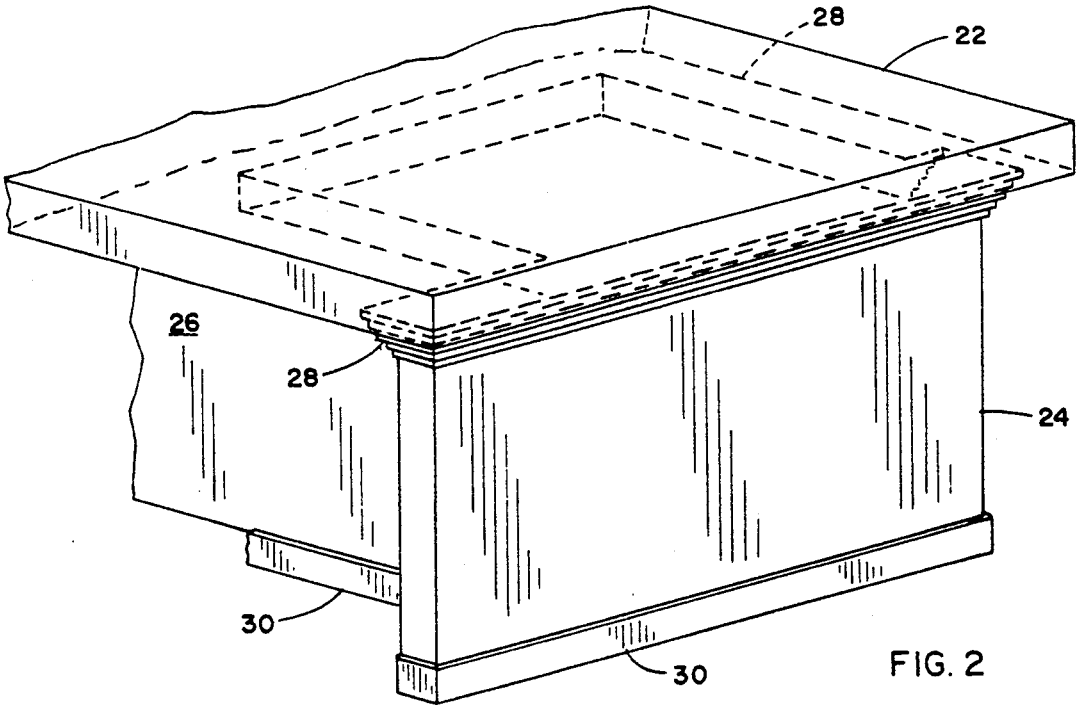
FIG. 2 is a fragmentary perspective view of the article in FIG. 1, taken from a front and top portion thereof.

Referring now to the drawings and the embodiments illustrated therein, the right half of a furniture article 20 embodying the present invention is shown in FIG. 1-2, the left half being an identical mirror image thereof. Furniture article 20 is essentially a pedestal-type desk having a top panel 22 connected at each side to an outer side panel 24, an inner side panel 25 and a cross panel 26 by upper and lower connector brackets 28 and 30. Connector brackets 28 and 30 are constructed to snappingly attach to side panels 24 and 25 to facilitate interconnecting panels 22, 24, and 25 during assembly, without the need for separate clamping fixtures, and with a minimum of tools and parts. Brackets 28 and 30 also include apertures and tabs to receive fasteners if required for permanently interconnecting panels 22, 24, 25, and 26. Thus, brackets 28 and 30 simplify assembly of article 20 by reducing assembly time, tools, and skill level required. Further, panel edges are captured and covered, thereby improving the quality and overall alignment, while reducing the need for finely machined edges and joints.

Figure 3:
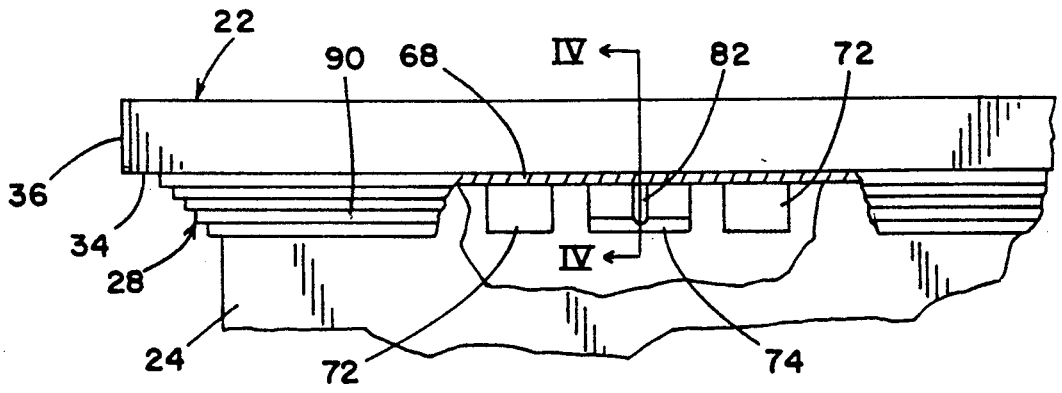
FIG. 3 is a fragmentary side elevational view of the article in FIG. 1 with portions thereof broken-away to expose a connector bracket.

Top panel 22 (FIG. 3) is substantially a flat, horizontally extending planar panel of wood or the like with a finished upper surface suitable for use as a worksurface. Top panel 22 includes a flat interior face or underside 34, and a laterally positioned marginal edge 36 which extends fully around top panel 22. In the embodiment shown, panel 22 is made of wood, but it is contemplated that panel 22 could also be made from any number of different structural materials.

Figure 11:
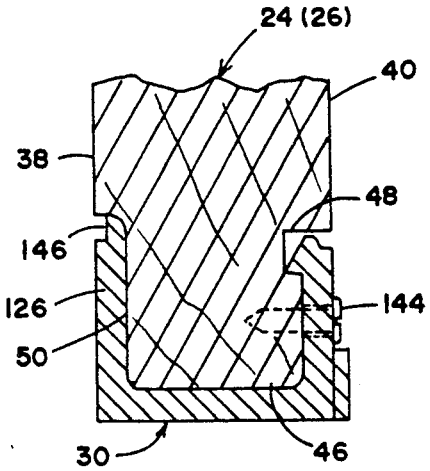
FIG. 11 is a cross-sectional view taken through lines XI—XI in FIG. 1.

Outer side panel 24 (FIG. 1) is a substantially flat planar panel of wood positioned vertically under top panel 22. Side panel 24 (FIG. 4) defines opposing faces, one of which is an exterior face 38 and the other of which is an interior face 40. Side panel 24 further includes a top or first edge 42. A groove 44 extends parallel to top edge 42 on interior face 40 a distance below first edge 42. Near the bottom of side panel 24 (FIG. 11) is a bottom or second edge 46. A second groove 48 extends parallel to bottom edge 46 on interior face 40 a distance above bottom edge 46. A notch 50 is cut along bottom edge 46 and extends upwardly into exterior face 38.

Inner side panel 25 (FIG. 1) is positioned parallel to side panel 24 and forms an alcove with outer side panel 24 for receiving a drawer or the like. Inner side panel 25 is substantially similar to side panel 24 and is similarly captured at its upper and lower ends by upper and lower connector brackets 28 and 30.

Cross panel 26 (FIG. 1) is a substantially flat vertically extending planar panel of wood and oriented normally to both top panel 22 and side panel 24. Cross panel 26 is positioned against side panel 24, and recessedly into upper connector bracket 28 and lower connector bracket 30. In the embodiment shown, cross panel 26 has no grooves or notches, but is merely abutted against brackets 28 and 30 and secured in place by screws attached through vertically extending attaching tabs 101 and 147 as discussed below.

Figure 10:
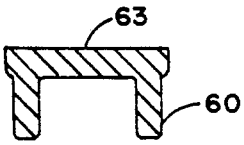
FIG. 10 is a cross-section taken through lines X—X in FIG. 5.

Upper connector bracket 28 (FIG. 5) is a rectangularly-shaped part having an exterior frame substantially in the shape of a picture frame. The exterior frame is defined by a front member 52, rear member 54, outer side member 56, and inner side member 58 which are shown at 90° angles, but could be at different angles. In the embodiment shown, outer side member 56 extends forwardly of front member 52 defining a protruding member 64 which creates an alcove with front member 52 for the knees of a person sitting in front of desk 20, as discussed below. Protruding member 64 could, of course, be left off of upper connector bracket 28 depending on the design of article 20. As shown, bracket 28 further includes cross braces 60 which extend between the inner corners of members 52, 54, 56, and 58 to dimensionally stabilize bracket 28 and assure a square and stable assembly. Diagonally extending cross braces 60 (FIG. 10) have a 'U'-like cross-sectional shape for strength and rigidity including a flat upper surface 63 that aligns with the generally overall flat upper surface 67 of upper connector bracket 28. Cross braces 62 can be added to further strengthen cross braces 60 and further assure the dimensional integrity of connector bracket 28, cross braces 60 and side members 56, 58. Also contributing to the integrity of upper connector bracket 28 is outer side wall 70 which extends continuously around the perimeter of bracket 28 but inside of trim apron 90.

Upper connector bracket 28 (FIGS. 5-9) includes three major features that are coordinatingly positioned on bracket 28, the location and design of each of which depends upon the article of furniture being formed and the placement necessary to optimize the function and utility of bracket 28. The first major feature includes at least one elongated channel 66 and associated temporary and/or permanent attaching means that captures the edges of side panels 24 and 25, thus allowing bracket 28 to temporarily fix panels 24 and 25 relative to top panel 22, and then permanently interconnect the same to form a rigid assembly. The attaching means also locates and allows the secure interconnection to cross panel 26 and top 22. The second major feature is the planar upper surface 67 of bracket 28 which with attaching tabs 75 and locator pins 75A permit secure location and attachment of bracket 28 to top panel 22. The third feature includes a trim apron which aesthetically closes off the groove-like exterior seam formed by the butt joint between panels 22 and 24 and also between panels 22 and 26 to give the butt joint an aesthetic appearance. The trim apron can be a separate decorative member such as aesthetic trim apron 90 having decorative outer surface 94 (FIG. 4), or can be an integral member such as outer side wall 126 having lip 146 (FIG. 11), as discussed below.

Figure 4:
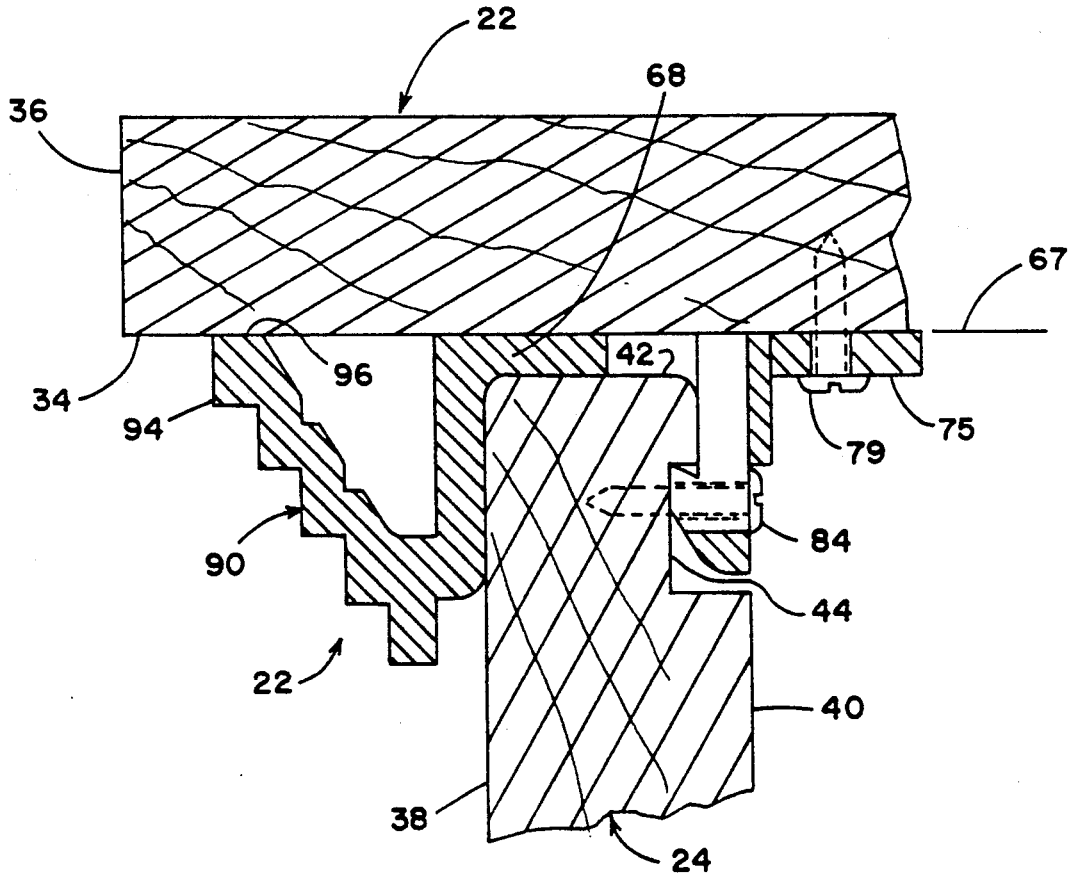
FIG. 4 is a cross-sectional view taken through lines IV—IV in FIG. 3.

Channel 66 (FIG. 5) defines a downwardly facing pocket which extends substantially the length of members 56, 58, and 64 of upper connector bracket 28. The size of the pocket may vary depending upon the thickness of side panel 24. Alternatively, a single connector bracket can be used for multiple thicknesses of wood panels by machining the edge of the wood panels so that they mateably fit into channel 66. Channel or pocket 66 (FIG. 8) is defined by an upper wall 68, outer side wall 70, and foreshortened inner side wall segments 72 which form a U-shaped channel or pocket for receiving the first edge 42 of a panel 24 (FIG. 4). Positioned adjacent and between two foreshortened inner side walls segments 72 is a snap-lock or locking member 74 (FIG. 7) that includes a resiliently flexible extension 76 and hook or head 78. Hook 78 includes an inwardly facing tooth 80 that engages groove 44 of side panel 24 (FIG. 4) to securely hold side panel 24 within channel 66 during assembly. The outer end of hook 78 has an outer surface that is tapered to facilitate installation of first edge 42 of side panels 24, 25 into channel 66. Snap-lock member 74 (FIG. 7) further includes an aperture or slot 82 that permits installation of a screw 84 (FIG. 4) for positive permanent attachment of side panel 24 to upper connector bracket 28. Screw 84 not only secures connector bracket 28 to side panel 24, but also secures snap-lock member 74 in place in groove 44 on side panel 24. The design of slot 82 also facilitates the molding of snap-lock member 74 integrally on connector bracket 28. A reinforcing rib 86 along the outer side of extension 76 strengthens snap-lock member 74 to increase the resistance to deformation of member 74. A second reinforcing rib 88 (FIG. 8) is positioned normally to foreshortened inner side wall 72 on attaching tab 75 and extends away from channel 66. Rib 88 reduces the tendency of inner wall 72 of channel 66 to deformably spread apart from outer wall 70 due to the weight of top panel 22 pushing downwardly on tab 75 in cantilever fashion on inner wall 72. Thus, top panel 22 is able to biasingly hold inner wall 72 in position to maintain a snug pocket for receipt of panel 24 (and 25). Tabs 75 include a hole 77 for receiving a screw 79 (FIG. 4) to secure upper connector bracket 28 to top panel 22. Snap lock members 74, foreshortened inner side wall segments 72, and tabs 75 are located around the inside of members 52, 56 and 58 of upper connector bracket 28 as desired, depending upon the size and function requirements of the furniture article being constructed.

Figure 5:
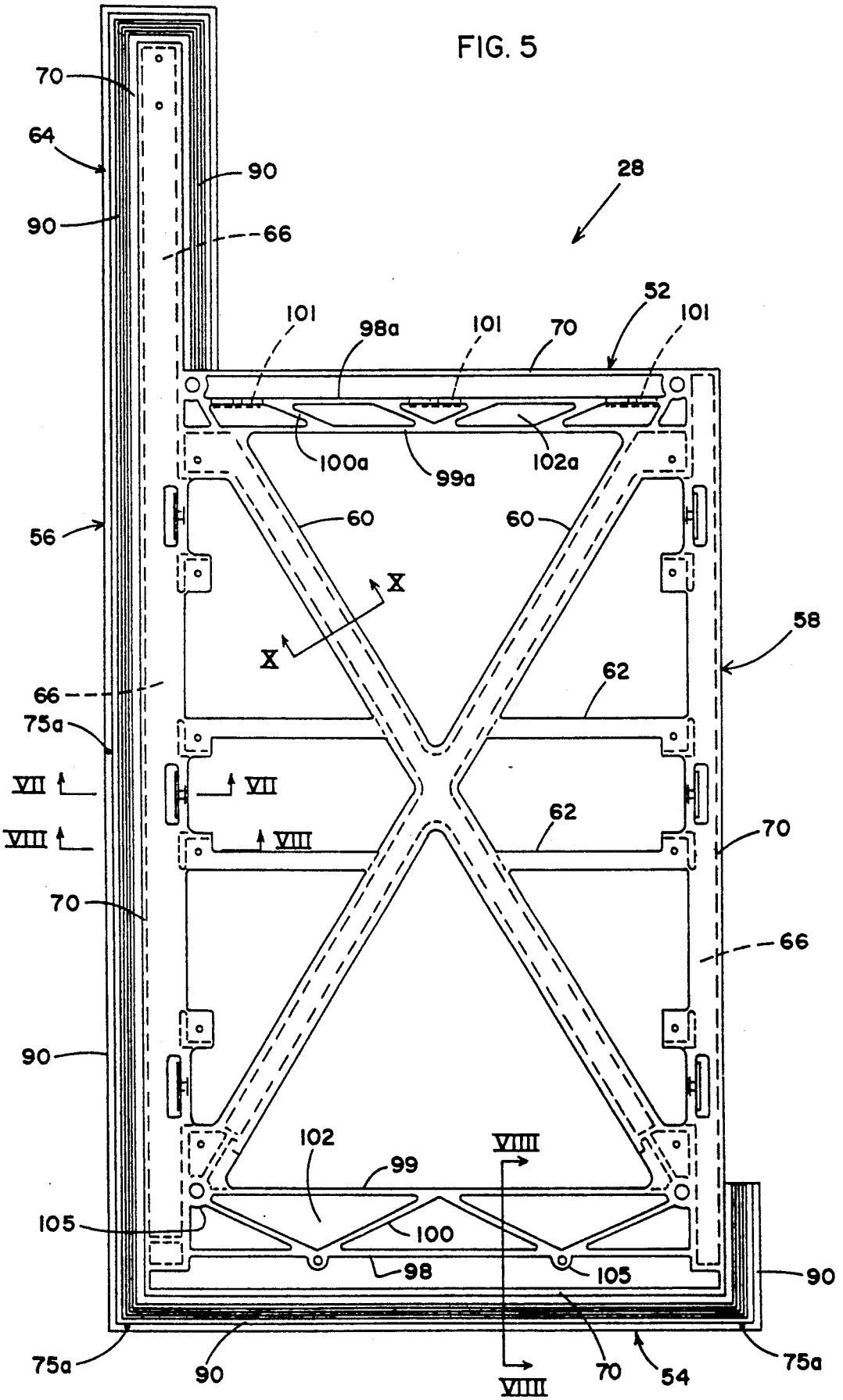
FIG. 5 is a top plan view of the upper connector bracket.

Aesthetic trim apron 90 (FIG. 8) attaches to the outer lower edge of outer side wall 70 on members 54, 56 and 64 and a portion of member 58 (FIG. 5) and extends diagonally outwardly and upwardly therefrom. Aesthetic trim apron 90 includes a finished decorative outer surface 92 and a free edge 94. Free edge 94 defines an upper surface 96 which aligns with planar upper surface 67 and abuts the interior face 34 of top panel 22 near the outer marginal edge 36. By abutting top panel 22, aesthetic trim apron 90 covers the butt joint or seam 98 formed between side panel 24 (and 26) and top panel 22. Aesthetic trim apron 90 also mechanically supports outer side wall 70 in an inward direction on channel 66 in a cantilever fashion by the weight of top panel 22 acting on free edge 94. Thus, walls 70 and 72 do not spread apart and channel 66 reliably snugly receives side panel 24 (and side panel 25). Trim apron 90 further provides beam-like strength to prevent protruding leg 64 from drooping (FIG. 5).

In the embodiment shown, rear member 54 (FIG. 9) is constructed to be a rigid beam-like structure as is needed over a drawer (not shown). Rear member 54 includes laterally extending outer wall 70 and inner walls 98 and 99 that are reinforced by ribs 100 and further supported by a lower wall 102 with flat lower surface 104. Lower wall 102 is designed to cooperate with a drawer by providing a beam-like rigid support over the drawer area. Lower wall 102 could also provide a structure to be used with a locking device (not shown) to lock the drawer in a closed position. Hollow bosses 105 permit secure attachment of rear member 54 to top panel 22. Aesthetic trim apron 90 extends diagonally upwardly and outwardly from outer side wall 70 of rear member 54. The upper surfaces of rear member 54 form a flat surface which is aligned with and part of flat upper surface 67 of upper connector bracket 28. In the embodiment shown, rear member 54 does not include a channel 66, although such a channel could be readily incorporated into rear member 54 such as between walls 70 and 98.

Figure 6:
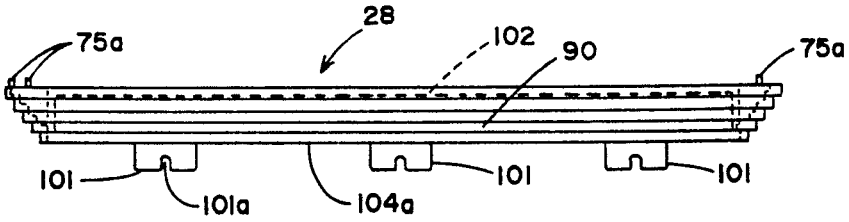
FIG. 6 is a front elevational view of the article in FIG. 5.
Figure 7:
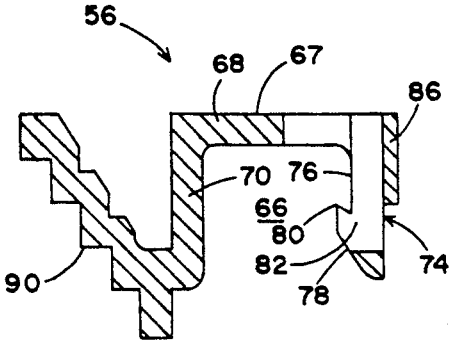
FIG. 7 a cross-section taken through lines VII—VII in FIG. 5.
Figure 8:
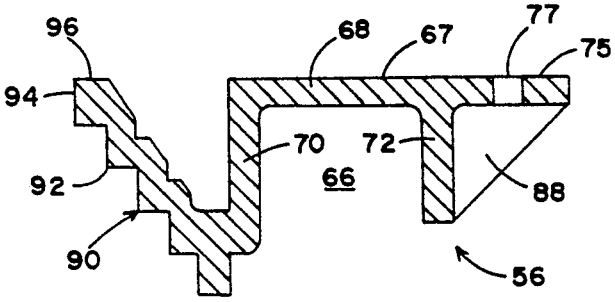
FIG. 8 is a cross-section taken through lines VIII—VIII in FIG. 5.
Figure 9:
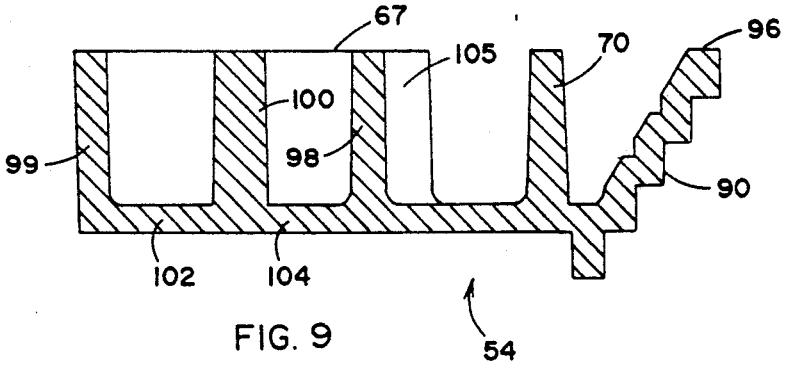
FIG. 9 is a cross-section taken through lines IX—IX in FIG. 5

Front member 52 (FIG. 5) is similar to rear member 54 and includes laterally extending walls 98A and 99A reinforced by multiple diagonally extending reinforcing ribs 100A and a lower wall 102A having a substantially flat surface 104A (FIG. 6). Cross panel 26 abuts flat surface 104A and is attached to connector bracket 28 by fasteners which attach through slots 101A in vertical tabs 101. It is contemplated that front member 52 will be a beam-like structural member cooperating with rear member 54 and cross braces 60, 62 to maintain the dimensional integrity of connector bracket 28. However, it is also contemplated that front member 52 could be constructed with a channel 66 which would capture the associated edge of cross panel 26, depending upon the functional and aesthetic requirements of the furniture article being constructed. The channel could be located, for example, between walls 70 and 98A.

Figure 12:
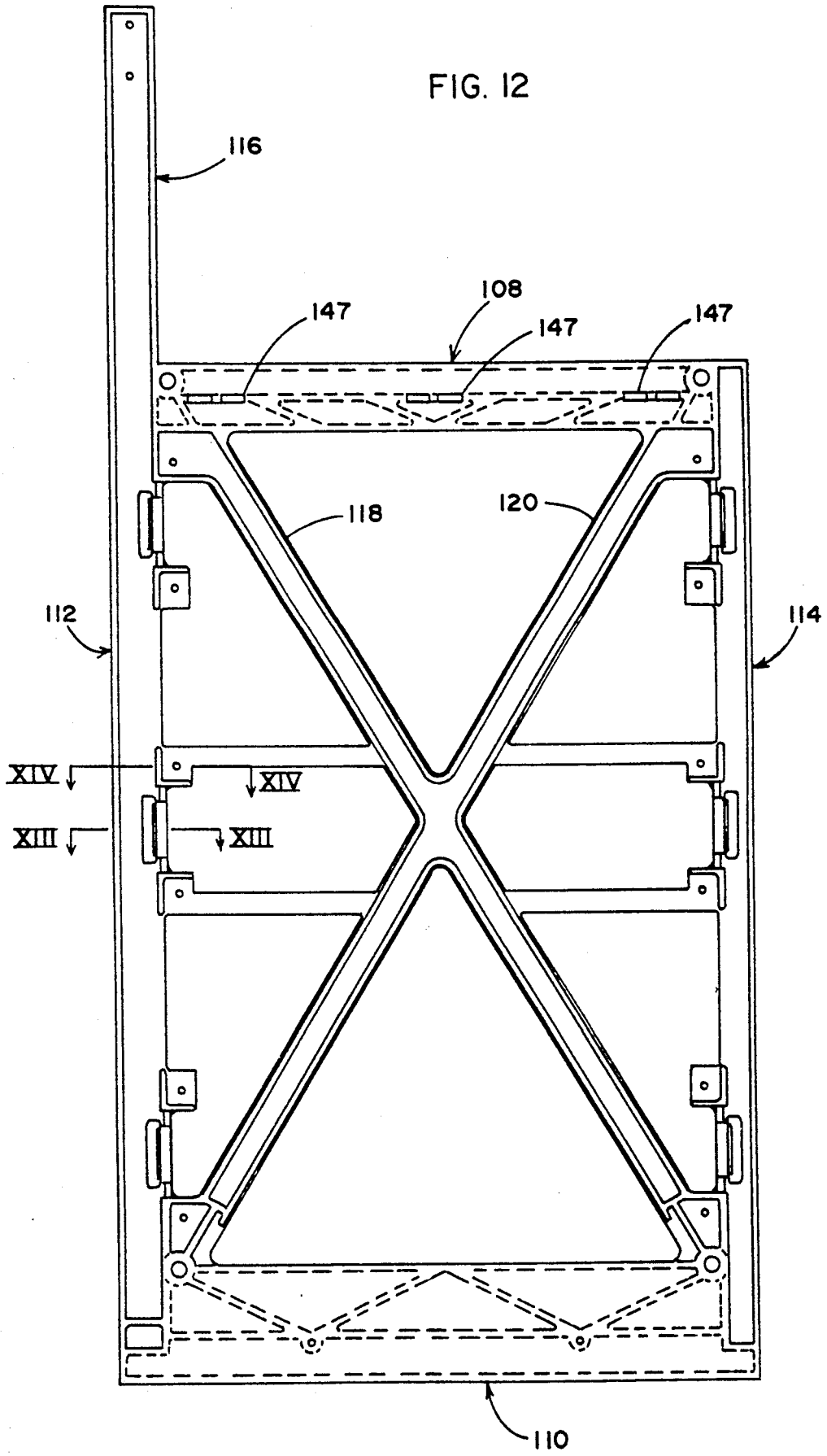
FIG. 12 is a top plan view of the lower connector bracket.
Figure 13:
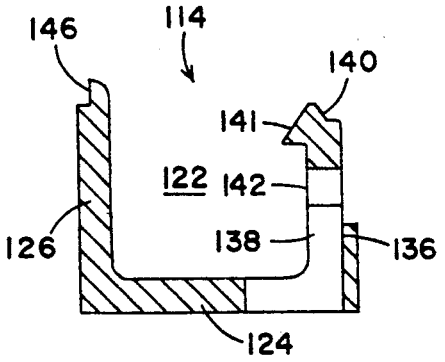
FIG. 13 is a cross-section taken through lines XIII—XIII in FIG. 12.
Figure 14:
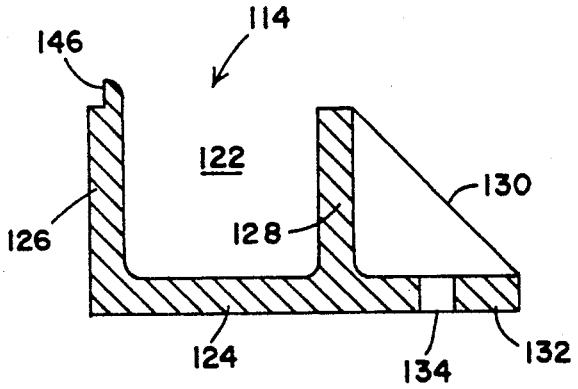
FIG. 14 is a cross-sectional view taken through lines XIV—XIV in FIG. 12.

Lower connector bracket 30 (FIGS. 12–14) is a rectangularly-shaped part having an exterior frame (FIG. 12) corresponding to and, in the illustrated embodiment, substantially similar to upper connector bracket 28. The exterior frame is defined by a front member 108, rear member 110, outer side member 112 and inner side member 114. In the embodiment shown, outer side member 112 extends forwardly of front member 108 defining a protruding member 116 which cooperates with protruding member 64 of upper connector bracket 28, side panel 24 and cross panel 26 to create an alcove for the knees of a visiting person sitting in front of desk 20. Lower connector bracket 30 further includes diagonally extending cross braces 118 which extend between the inner corners of members 108, 110, 112, and 114 and also braces 120 to dimensionally stabilize bracket 30 to assure a square and stable assembly. In the embodiment shown, cross braces 118 have a 'U'-like cross-sectional shape for strength and rigidity, although it is contemplated that several different alternatives cross-sectional shapes may be constructed depending on the strength and rigidity required.

It is contemplated that lower connector bracket 30 can include and mirror the major features of upper connector bracket 28. However in the embodiment shown, lower connector bracket 28 is contemplated to primarily include only the channel means and attaching means for side panels 24 and cross panel 26, with the trim apron being substantially incorporated into the outer wall of the channel means. Specifically, lower connector bracket 30 (FIG. 14) includes a channel 122 with lower side wall 124, outer side wall 126 and foreshortened inner side wall segment 128. A reinforcing rib 130 extends diagonally from inwardly extending tab 132 to support foreshortened inner side wall 128 to prevent spreading or opening of channel 122 due to undesired movement of inner side wall 128. Tab 132 includes a hole 134 that can be used to securely attach lower connector bracket 30 to a floor or horizontal lower planar member (not shown). Positioned between adjacent foreshortened inner side walls 128 is a snap-lock member 136 (FIG. 13) that includes a resilient flexible extension 138 and a hook 140. Hook 140 includes an inwardly facing tooth 141 that engages groove 48 in side panel 24 (or 25) to securely hold side panel 24 within channel 122 during assembly. Snap-lock member 136 further includes an aperture or hole 142 (FIG. 13) that permits installation of a screw 44 (FIG. 11) for positive permanent attachment of panel 24 to lower connector bracket 30. Outer side wall 126 is constructed to mateably slip within notch 50 on side panel 24 (and side panel 25). The upper edge of outer side wall 126 (FIG. 11) includes a recessed lip 146 that creates an aesthetic seam along the joint formed by the upper edge of outer side wall 126 with notch 50 of side panel 24. Recessed lip 146 is designed to reduce the visual focus on the intersection between outer side wall 126 and side panel 24 thus reducing the criticalness of a dimensionally perfect fit.

Front and rear members 108 and 110 of lower connector bracket 30 are contemplated to be substantially similar to front and rear members 52 and 54 of upper connector bracket 28, members 108 and 110 including similar bracing to achieve structural and dimensional rigidity and also similar attaching means such as vertical attaching tabs 47.

It is contemplated that upper and lower connector brackets 28, 30 will be made of plastic to facilitate their manufacture, and also that they will be black in color to maximize their aesthetic appeal, however alternative materials and colors are contemplated. Also, an almost infinite amount of Variations are possible in the arrangement and specific location and design of the cross braces, attaching tabs, and trim apron.

Having described the components of the present invention, the advantages and uses of the invention embodied therein will become apparent to one skilled in the art. Though different assembly sequences are possible, only one is described below. Of particular interest is that the furniture articles potentially can be assembled by use of only a screw driver and hammer. Briefly, upper connector bracket 28 is positioned on interior face or underside 34 of top panel 22 by use of locating pins 75A, and attached by screws 79 through attaching tabs 75 into top panel 22. In this position, free edge 94 of trim apron 90 is positioned somewhat inwardly of marginal edge 36 of top panel 22 thereby allowing the decorative outer surface 92 of aesthetic trim apron 90 to aesthetically join with interior face 34 to form an aesthetic and attractive union. Outer side panel 24 and inner side panel 25 are then installed with top edge 42 of panels 24 and 25 being positioned within channel 66 on members 56 and 58 of upper connector bracket 28. Hook 78 of snap-lock member 74 has an outer surface that is tapered to facilitate the installation of first edge 42 within channel 66. Once installed, snap-lock member 74 snappingly engages groove 44 in side panel 24 to securely retain side panel 24 therein. At this moment, panels 24 and 25 are only temporarily interconnected to top panel 22. Lower connector bracket 30 is then snappingly attached to the bottom edge 46 of side panels 24 and 25. Snap-lock members 136 snappingly engage grooves 48 and outer side wall 126 slideably engages notch 50. Cross panel 26 is then placed between front members 52 and 108 of uppe and lower connector brackets 28, 30 and against vertical tabs 101 and 147, and secured in place by fasteners. Screws 84 are then screwed into slot 82 of snap-lock member 74 permanently securing panels 22 and 24 to upper connector bracket 28 to form a rigid interconnection. Similarly, screws 144 are securely attached through holes 142 and securely into panels 24 and 25.

The assembly is then rotated to an upright position. In this upright position, article 20 forms a rigid and stable furniture article having a forwardly facing alcove formed by the front of panels 24 and 26, and below top panel 22 such as to receive knees of a visitor. Article 20 as constructed further includes space for compartments on either side of a seated user such as for file drawers and the like. These file drawers (not shown) would be positioned between upper and lower connector brackets 28 and 30, and inside of the area formed by side panels 24, 25, cross panel 26 and top panel 22. A center desk drawer could also be added.

Figure 15:
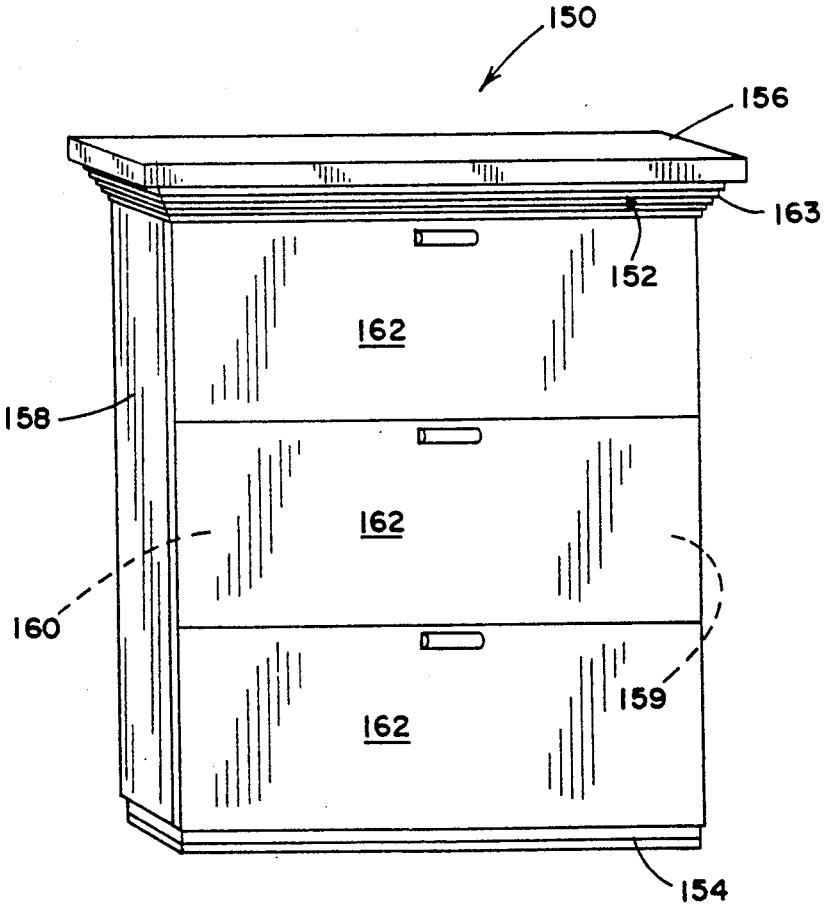
FIG. 15 is a perspective view of a second embodiment.
Figure 16:
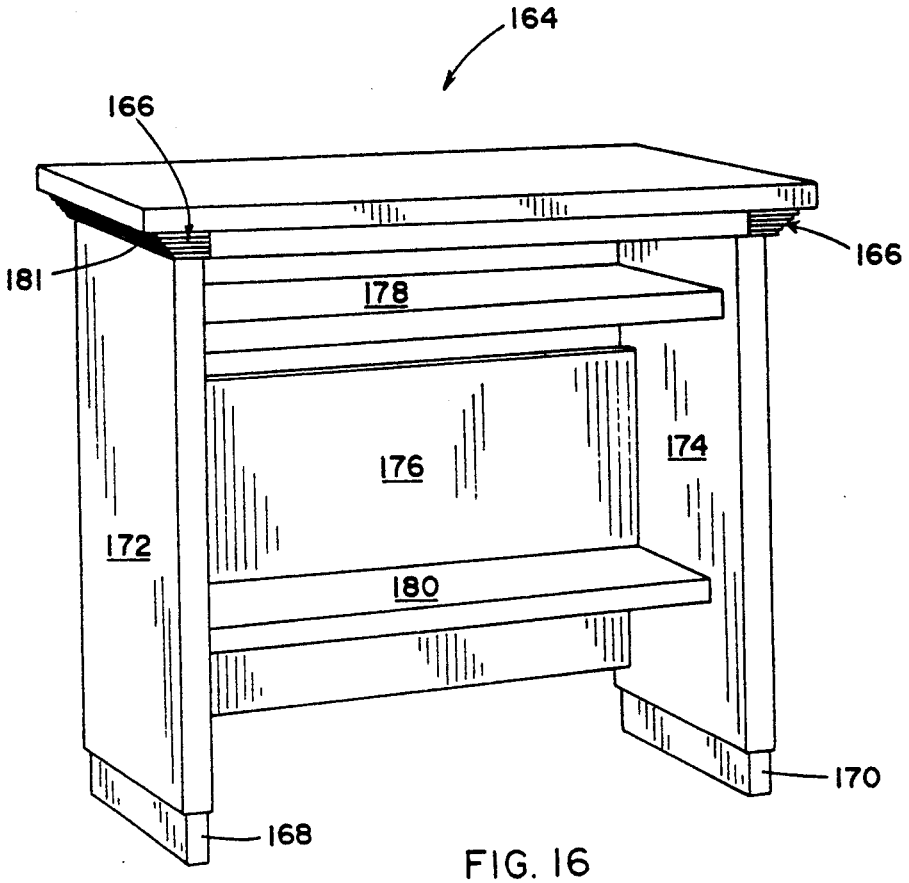
FIG. 16 is a perspective view of a third embodiment.
Figure 17:
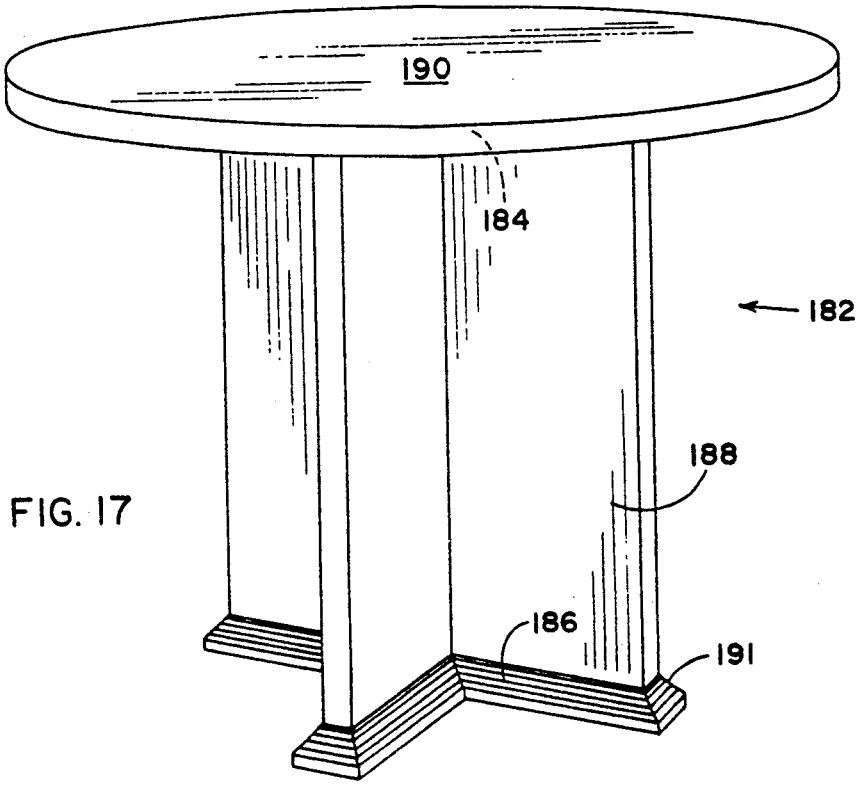
FIG. 17 is a perspective view of a fourth embodiment.

It is contemplated that the present invention can be utilized in a variety of different embodiments such as are illustrated in FIGS. 15–18. Illustrated in FIG. 15 is a three-drawer cabinet 150 having an upper connector bracket 152 and bottom panel 154 which rigidly interconnect top panel 156, side panels 158, 159 and cross panel 160. In this embodiment, bracket 152 and bottom panel 154 join panels 156, 158, 159 and 160 to form a rigid forwardly facing opening in cabinet 150. Drawers 162 are attached to tracks (not shown) located on the inside of side panels 158, 159 for fore and aft movement. As can be seen, upper connector bracket 154 includes a trim panel 163 that extends along at least three sides of cabinet 150.

A second embodiment (FIG. 16) shows a stand 164 such as can be used as a computer stand or printer stand, stand 164 having two upper connector brackets 166, and two lower brackets 168 and 170 (although a single upper and single lower connector bracket could also be used). In this embodiment, upper connector bracket 166 provides a channel or pocket (not shown) for receiving side panels 172 and 174. A cross panel 176 is securely attached to side panels 172 and 174 along with shelves 178 and 180 to form a rigid furniture article. As can be seen, upper connector brackets 166 include a trim apron 181 extending along at least three sides of side panels 172 and 174.

A table 182 (FIG. 17) illustrates a fourth embodiment wherein one could have upper and lower connector brackets 184 and 186 which would have an 'X'-like shape and be positioned in opposing relationship on either end of an 'X'-shaped pedestal support 188. Support 188 is made of two or more panels which are fixedly located and positioned by connector brackets 184, 186. A tabletop 190 is secured to the top of upper connector bracket 184 so as to form a secure and rigid structure. Table 182 illustrates the use of a lower connector bracket having a trim apron 191.

In the foregoing description, it will be readily appreciated by those skilled in the art that modifications can be made to the invention without departing from the concepts disclosed herein. Such modifications are to be considered as included in the following claims, unless these claims by their language expressly state otherwise.

The embodiments of the invention in which as exclusive property or privilege is claimed are defined as follows.

1. In a furniture article of the type having a top and at least one support pedestal therefor, an improved pedestal construction, comprising:

at least first and second rigid structural panels adapted for supporting weight thereon; said first and second structural panels each having a top edge, a bottom edge, and a finished exterior surface;

an upper connector bracket having a rigid frame with at least first and second downwardly opening channels mutually disposed at a preselected angle, and shaped to closely receive the upper edges of said first and second structural panels therein to securely interconnect the same in a freestanding, self-supported pedestal configuration, and including a downwardly projecting trim apron which extends substantially continuously along said first and second channels and overlies at least the exterior surfaces of said first and second structural panels to impart a neat, finished appearance along an upper portion of said support pedestal;

a lower connector bracket, shaped complementary to said upper connector bracket, and having a rigid frame with at least first and second upwardly opening channels mutually disposed at said preselected angle, and shaped to closely receive the lower edges of said first and second structural panels therein to securely interconnect the same in said freestanding, self-supported pedestal configuration, and including a downwardly projecting base which forms a ground engaging support for said support pedestal, with an upwardly projecting trim apron that extends substantially continuously along the first and second channels of said lower connector bracket and overlies at least the exterior surfaces of said first and second structural panels to impart a neat, finished appearance along a lower portion of said support pedestal;

means for fastening said first structural panel to said upper and lower connector brackets;

means for fastening said second structural panel to said upper and lower connector brackets; and means for fastening said top to said support pedestal, whereby said first and second brackets serve to quickly, yet securely interconnect said first and second structural panels to form a rigid pedestal for said furniture articles, with a finished appearance, and without any direct interconnection between said first and second structural panels.

2. The apparatus as defined by claim 1 wherein one of said structural panels includes a first lock positioned adjacent to one of said edges, and the one of said upper and lower connector bracket associated with said one edge includes a second lock, shaped to resiliently and flexiby engage said first lock to retain said one structural panel in said associated connector bracket with a snap-lock.

3. The apparatus as defined by claim 2 wherein said second lock and also said means for fastening said first and second structural panels forms a part of one of said channels.

4. The apparatus as defined by claim 3 wherein at least one of said upper and lower brackets include a cross brace to maintain dimensional integrity during assembly.

5. A freestanding furniture article comprising:

a first panel having first opposing edges, and first opposing faces;

a second panel having second opposing edges, and second opposing faces;

a third panel having an interior face shaped for positioning adjacent one of said first opposing edges of said first panel and one of said second opposing edges of said second panel;

a first elongate connector bracket interposed between said first panel and said third panel and between said second panel and said third panel and including first, second, and third portions thereof fastened to said first, second, and third panels, respectively; said first and second portions including first channel means for receiving and capturing said ones of said first and second opposing edges to fix the spacial position of said ones of said first and second opposing edges relative to said third panel, said channel means shaped to receive said first and second panels from a direction normal to the longitudinal dimension of said channel means;

a second elongate connector bracket including first and second portions having second channel means for receiving and capturing the other ones of said first and second opposing edges to fix the spacial position of said other ones of said first and second opposing edges;

attaching means associated with said first and second connector brackets for temporarily interconnecting said first, second, and third panels to form an intermediate semi-rigid assembly to facilitate assembly, and also for subsequently permanently rigidly interconnecting same.

6. The article as defined by claim 5 wherein said connector brackets include a substantially continuous outer wall that forms a portion of said channel means.

7. The article as defined by claim 6 wherein said connector brackets include a substantially continuous outer wall that forms a portion of said channel means; and wherein said first and second panels each include a groove located parallel to one of said opposing edges, said groove cooperating with said locking means to temporarily hold said first and second panels to said connector bracket during assembly.

8. The article as defined by claim 7 wherein said locking means includes a resilient hook constructed to snappingly engage said groove.

9. The article as defined by claim 8 wherein said attaching means forms a part of said channel means.

10. The article as defined by claim 9 wherein said resilient hook forms a part of said channel means.

11. The article as defined by claim 10 wherein said attaching means on at least one of said connector brackets includes multiple apertures located along said channel means, said apertures constructed to receive fasteners to permanently securely interconnect said first, second, and third panels to said at least one connector bracket.

12. The article as defined by claim 11 wherein said locking means includes a flexibly resilient extension on which said hook is located, said extension including an aperture constructed to receive one of said fasteners, said one fastener thereby holding said hook in place after said one fastener is fully installed.

13. The article as defined by claim 12 including a fourth panel having fourth opposing edges and fourth opposing faces, said first, second, and fourth panels arranged in a U-shaped arrangement and positioned generally normally to said third panel, and said first channel means including structure to capture one of said fourth opposing edges.

14. The article as defined by claim 13 including a drawer means slideably positioned in said U-shaped arrangement.

15. The article as defined by claim 14 wherein at least one of said connector brackets includes a cross brace to maintain squareness during assembly.

16. The article as defined by claim 5 wherein said first connector bracket includes a trim apron extending generally continuously therealong, said trim apron including a free edge shaped to abuttingly mate with the interior face of said third panel, said trim apron having a finished decorative outer surface to provide a neat, finished appearance upon assembly.

17. The article as defined by claim 16 wherein said first channel means includes an outer wall, and said trim apron is connected to said outer wall and stabilizes said outer wall so as to prevent undesirably spreading apart of said channel means.

18. The article as defined by claim 5 wherein said first channel means defines a substantially continuous shaped pocket including an outer wall which extends along at least two sides of said connector bracket thereby geometrically capturing said one of said first and second opposing edges.

19. The article as defined by claim 5 wherein said first and second connector brackets each include a substantially continuous outer wall that forms a portion of said channel means along at least two sides of said connector brackets.

20. The article as defined by claim 5 including a fourth panel having fourth opposing edges and fourth opposing faces, said first, second, and fourth panels arranged in a U-shaped pattern and positioned generally normally to said third panel, and said first channel means including a fourth portion including channel means for receiving and capturing one of said fourth opposing edges.

21. The article as defined by claim 5 wherein at least one of said connector brackets includes a cross brace to maintain squareness during assembly.

22. A freestanding furniture article comprising:

a first panel having a first edge and first opposing faces;

a second panel having a second edge and second opposing faces;

a third panel having an interior face shaped for positioning adjacent said first edge of said first panel and said second edge of said second panel;

an elongate connector bracket interposed between said first panel and said third panel and between said second panel and said third panel, and including first, second, and third portions thereof fastened to said first, second, and third panels, respectively; said first and second portions including channel means having a generally continuous shaped structure for receiving and capturing said first and second edges to fix the spacial position of said first and second edges; said channel means including snap-lock means for temporarily holding said first and second panels during initial assembly, and further including fastener receiving means for permanently interconnectingly securing said first, second and third panels to said connector bracket to form a rigid assembly after initial assembly, said snap-lock means including a channel side wall for engaging one of said opposing faces of said first or second panel and a resilient protruding member opposite said channel side wall for releasably resiliently engaging the other of said opposing faces of said first or second panel to hold said panel biasingly against said channel side wall and in the channel means.

23. The article as defined by claim 22 wherein said protruding member includes an aperture for receiving a screw to permanently hold said protruding member against the other of said opposing faces, said aperture forming a part of said fastener receiving means.

24. In a furniture article of the type which includes a plurality of panels to form a unit interconnected, the improvement comprising:

a first panel having a first edge, and an exterior face;

a second panel having an interior face shaped for positioning adjacent the first edge of said first panel, and a marginal edge positioned to extend outwardly from the exterior face of said first panel to define an overhung portion of said second panel;

an elongate connector bracket interposed between said first panel and said second panel, and including a first portion thereof fastened to said first panel, and a second portion thereof fastened to said second panel to fixedly interconnect said first panel and said second panel along a butt joint that forms a groove-like exterior seam therebetween; said connector bracket including a trim apron extending generally continuously therealong, with a free edge shaped to abuttingly mate with the interior face of said second panel at the overhung portion thereof; said trim apron having a finished decorative outer surface, whereby said connector bracket securely yet economically interconnects said first panel and said second panel along said butt joint, and simultaneously covers said exterior seam formed therebetween to provide a neat, finished appearance.

25. The article as defined by claim 24 wherein said first portion of said connector bracket includes channel means for receiving said first edge of said first panel whereby said first panel is stabilized relative to said second panel along said butt joint, and said first portion further includes attaching means for securing said first panel to said connector bracket.

26. The article as defined by claim 25 wherein said connector bracket includes a substantially continuous outer wall that forms a part of said channel means, and said trim apron attaches to said outer wall in a manner which stabilizes said outer wall.

27. The article as defined by claim 24 including a second rigid elongate connector bracket located at a lower end of said first panel, said second connector bracket providing support to said first panel and simultaneously covering said lower end of said first panel to provide a neat finished appearance, said second connector bracket further cooperating with said first connector bracket to provide a rigid stable assembly with said first and second panels.

28. The article as defined by claim 24 including a third panel positioned beside said first and second panels;

wherein said connector bracket includes a third portion fastened to said third panel and a fourth portion fastened to said second panel to fixedly interconnect said third panel and said second panel along a second butt joint that forms a second groove-like exterior seam therebetween, and wherein said trim apron extends generally continuously along that portion of said connector bracket adjacent the butt joint formed between said first and third panels.

29. The article as defined by claim 24 wherein said connector bracket is integrally molded of a resiliently flexible material.

30. The article as defined by claim 24 wherein said bracket is a one-piece integral molding.

31. The article as defined by claim 24 wherein said channel means extends along nonaligned portions of said connector bracket, said channel means forming a generally continuously shaped pocket facing normally away from said interior face and adapted to capture said first and third edges of said first and third panels.

32. The article as defined by claim 24 wherein said connector bracket includes a substantially continuous outer wall extending around at least a portion of the marginal edge of said connector bracket.

33. A furniture article comprising:

a first panel having a first edge and a first pair of opposing faces;

a second panel having a second edge and a second pair of opposing faces, said second panel located in a predetermined spacial position relative to said first panel with said first and second edges being located in a common plane;

a third panel oriented generally normally to said first and second panels and having an interior face positioned adjacent but spaced from said first and second edges of said first and second panels, said third panel further having a substantially flat surface opposing said interior face;

a first elongate connector bracket attached to said interior face of said third panel and including channel means defining an open shaped section for receiving and capturing said first and second edges of said first and second panels to temporarily fix the spacial position of said first and second edges;

attaching means associated with said first connector bracket for attaching said first and second panels to said first connector bracket so as to interconnectingly permanently form a rigid assembly with said third panel;

a second elongate connector bracket attached to said first and second panels opposite said first connector bracket;

a fourth panel positioned parallel to said second panel adjacent but spaced from said interior face of said third panel, said second and fourth panels located opposingly at either end of said furniture article, said fourth panel having a fourth edge and being located in a predetermined spacial position relative to said first panel with said fourth edge being located in the common plane with said first and second edges; and third and fourth rigid elongate connector brackets constructed to be substantially mirror images of said first and second connector brackets, respectively, and interconnected to said second, third, and fourth panels in a manner corresponding to the interconnection of said first and second connector brackets with said first, second, and third panels; said first and second connector brackets located at one end of said furniture article and said third and fourth connector brackets located at the other end of said furniture article, whereby the four panels and four connector brackets interconnect to form a rigid assembly for supporting said substantially flat surface in a desk-like configuration.

34. The article as defined by claim 33 wherein at least one of said connector brackets includes a cross brace to increase the rigidity of said connector bracket and to reduce angular distortion during assembly.

35. The article as defined by claim 33 wherein said attaching means includes snap-locking means for snappingly engaging said first panel to facilitate assembly of said article.

36. The articles as defined by claim 35 wherein said first panel includes at least one groove in one of said opposing face positioned parallel to said first edge and spaced therefrom, and said snap-locking means is constructed to snappingly engage said groove.

37. The article as defined by claim 36 wherein said snap-locking means includes a resiliently flexible extension and a hook located on the end of said extension, said hook engaging said groove in said first panel, said extension including a slot adapted to receive a fastener so as to permit the fastener to extend through said slot and into said first panel to permanently secure said first panel to said connector bracket.

38. The article as defined by claim 33 wherein at least one of said connector brackets also includes a trim apron.

39. The article as defined by claim 33 wherein said open shaped section forms a substantially continuous pocket which faces normally to said interior face of said third panel.

40. An assembly useful as furniture comprising:

a first panel oriented generally horizontally and having an interior face and a marginal edge;

at least one upstanding support member oriented generally normally to said first panel and having an end and multiple opposing side surfaces;

at least one rigid elongated connector bracket for each of said upstanding support members having a picture frame like shape attached to the underside of said first panel, said connector bracket including a substantially continuous wall defining at least one downwardly facing shaped pocket for receiving said first end and a portion of said multiple opposing side surfaces, said pocket including means for securely attaching said upstanding support member, said connector bracket further including a trim apron for aesthetically closing off the joint formed between said first panel and said upstanding support member, said trim apron connected to said continuous wall so as to support said pocket and prevent distortion or opening of said pocket; whereby one or more of said connector brackets can be assembled to said first panel and said at least one support member to form a stable and rigid furniture article with said first end of said support member being positioned in said shaped pocket and abuttingly against the underside of said top panel so that said top panel is supportingly held by said side panel and said connector bracket.

41. The article as defined by claim 40 including at least two of said support members.

* * * * *